US010757996B2

(12) United States Patent
Handorf et al.

(10) Patent No.: US 10,757,996 B2
(45) **Date of Patent: *Sep. 1, 2020**

(54) FOOTWEAR HAVING MEMORY FOAM

(71) Applicant: totes Isotoner Corporation, Cincinnati, OH (US)

(72) Inventors: Cherie Handorf, Maineville, OH (US); Walter Thomas Bray, Jr., Cincinnati, OH (US)

(73) Assignee: TOTES ISOTONER CORPORATION, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/861,034

(22) Filed: Sep. 22, 2015

(65) Prior Publication Data

US 2017/0079369 A1 Mar. 23, 2017

(51) Int. Cl.
*A43B 3/10* (2006.01)

(52) U.S. Cl.
CPC ..... *A43B 3/107* (2013.01)

(58) Field of Classification Search
CPC .... A43B 3/26; A43B 5/12; A43B 7/28; A43B 23/26; A43B 7/12; A43B 3/106; A43B 3/107
See application file for complete search history.

(56) References Cited

U.S. PATENT DOCUMENTS 2,911,973 A 11/1959 Chieffo
3,016,631 A 1/1962 Servin
3,063,074 A * 11/1962 Scholl ..... A43B 3/101 12/142 G
4,187,622 A * 2/1980 Sung ..... A43B 17/10 36/3 B
4,551,930 A * 11/1985 Graham ..... A43B 5/06 36/114
4,654,983 A * 4/1987 Graham ..... A43B 5/06 36/114
4,726,126 A * 2/1988 Bernhard ..... A43B 3/0031 36/71
5,012,541 A 5/1991 Ganon
(Continued)

FOREIGN PATENT DOCUMENTS

CN 201290384 Y 8/2009
CN 104605573 A 5/2015
WO 2015000036 A1 1/2015

OTHER PUBLICATIONS

Search Report issued in GB Appln. No. 1616067.3 dated Feb. 24, 2017.

(Continued)

*Primary Examiner* — Jila M Mohandesi
(74) *Attorney, Agent, or Firm* — Rossi, Kimms & McDowell LLP

(57) ABSTRACT

Footwear includes memory foam in at least a non-load bearing portion of the footwear to provide three-dimensional contouring to a foot. The footwear includes a top portion, a bottom portion, a pair of sides connecting the top portion with the bottom portion, and an opening formed between the top portion and the pair of sides to receive a foot. At least one of the top portion and the pair of sides includes memory foam providing three-dimensional contouring.

11 Claims, 2 Drawing Sheets

(56) References Cited

U.S. PATENT DOCUMENTS 5,261,169 A * 11/1993 Williford ..... A43B 17/102 36/43
5,289,644 A 3/1994 Driskill et al.
5,463,824 A * 11/1995 Barna ..... A43B 7/14 36/173
5,924,218 A * 7/1999 Dalvy ..... A43B 5/0405 36/55
5,985,383 A 11/1999 Allen et al.
6,112,432 A * 9/2000 Bray, Jr. ..... A43B 1/02 36/29
7,010,870 B2 3/2006 Mick
7,140,128 B2 * 11/2006 Huckle ..... A43B 23/26 36/45
7,254,906 B2 * 8/2007 Morris ..... A43B 7/06 36/27
7,493,230 B2 * 2/2009 Schwartz ..... A43B 17/00 702/139
7,827,707 B2 * 11/2010 Davis ..... A43B 3/26 36/71
7,845,095 B2 12/2010 Langvin et al.
8,302,330 B2 11/2012 Doran
8,856,968 B2 * 10/2014 Sherman ..... A61F 5/0111 2/239
2002/0083622 A1 * 7/2002 Joubert ..... A43B 5/0405 36/117.6
2005/0252040 A1 11/2005 Huckle
2006/0156578 A1 * 7/2006 Haft ..... A43B 3/107 36/9 R
2007/0283598 A1 * 12/2007 Gray ..... A41B 11/02 36/93
2009/0119947 A1 * 5/2009 Orvitz ..... A43B 7/141 36/44
2010/0018074 A1 * 1/2010 Greene ..... A43B 17/00 36/43
2011/0061148 A1 3/2011 Egozi
2013/0180131 A1 * 7/2013 Schwartz ..... A43B 1/0045 36/88
2013/0291407 A1 11/2013 Adair et al.
2013/0333243 A1 * 12/2013 Dushey ..... A43B 3/12 36/94
2014/0182049 A1 7/2014 Prust et al.
2014/0202045 A1 7/2014 Glassman
2014/0259762 A1 9/2014 Sukovic
2015/0257487 A1 * 9/2015 Ruiz ..... A43B 3/30 36/103

OTHER PUBLICATIONS

Office Action issued in U.S. Appl. No. 15/645,417 dated Sep. 28, 2018.
Office Action issued in U.S. Appl. No. 15/645,417 dated May 13, 2019.
Office Action issued in U.S. Appl. No. 15/645,417 dated Feb. 27, 2020.
Office Action issued in U.S. Appl. No. 15/645,417 dated May 26, 2020.
Notice of Allowance issued in U.S. Appl. No. 15/645,417 dated Jul. 1, 2020.

* cited by examiner

FOOTWEAR HAVING MEMORY FOAM

BACKGROUND

This disclosure relates to footwear having memory foam. Memory foam is typically positioned under the foot in footwear to provide cushioning that contours to unique features of individual feet. The footwear described herein provides memory foam positioned in the sides and/or top of the footwear, instead of just under the foot, to deliver the contouring and cushioning benefit of the memory foam to the sides and/or top of the foot.

While a variety of footwear have been made and used, it is believed that no one prior to the inventor(s) has made or used an invention as described herein.

SUMMARY

Footwear includes memory foam positioned on the top portion and/or sides of the footwear to deliver cushioning to non-load bearing areas of a user's foot.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
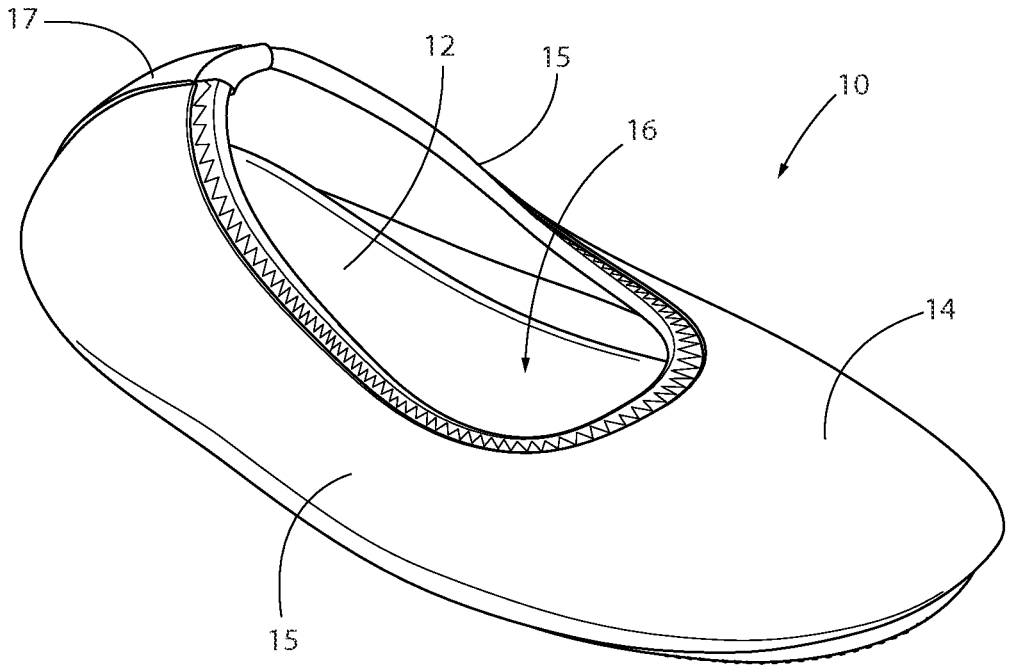
FIG. 1 depicts a top perspective view of an embodiment of footwear having memory foam.
Figure 2:
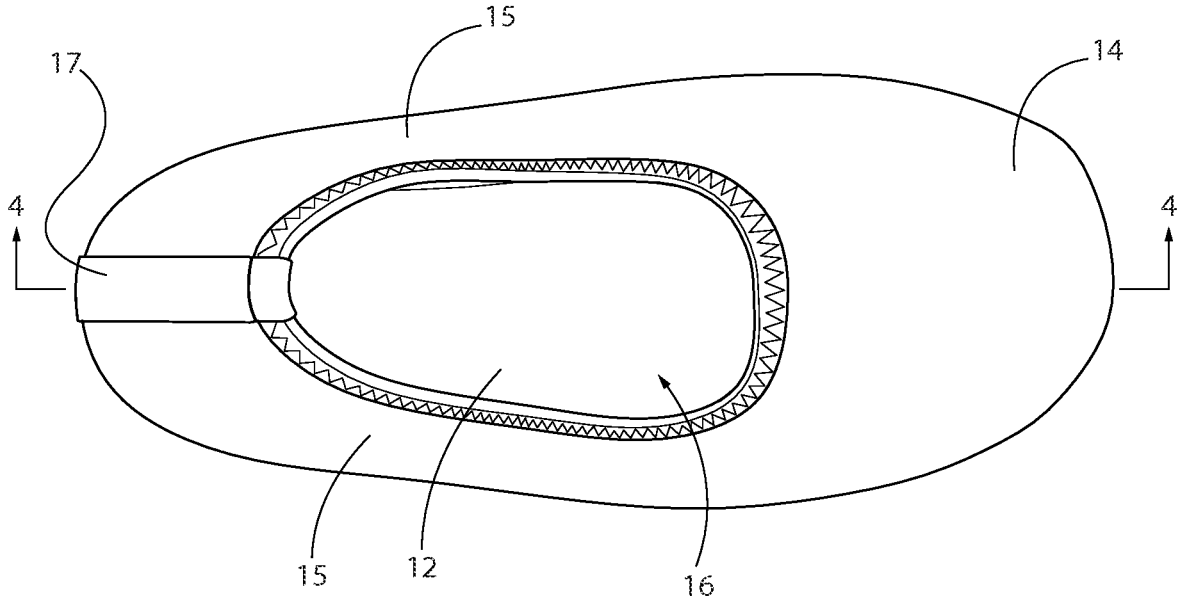
FIG. 2 depicts a top plan view of the footwear of FIG. 1.
Figure 3:
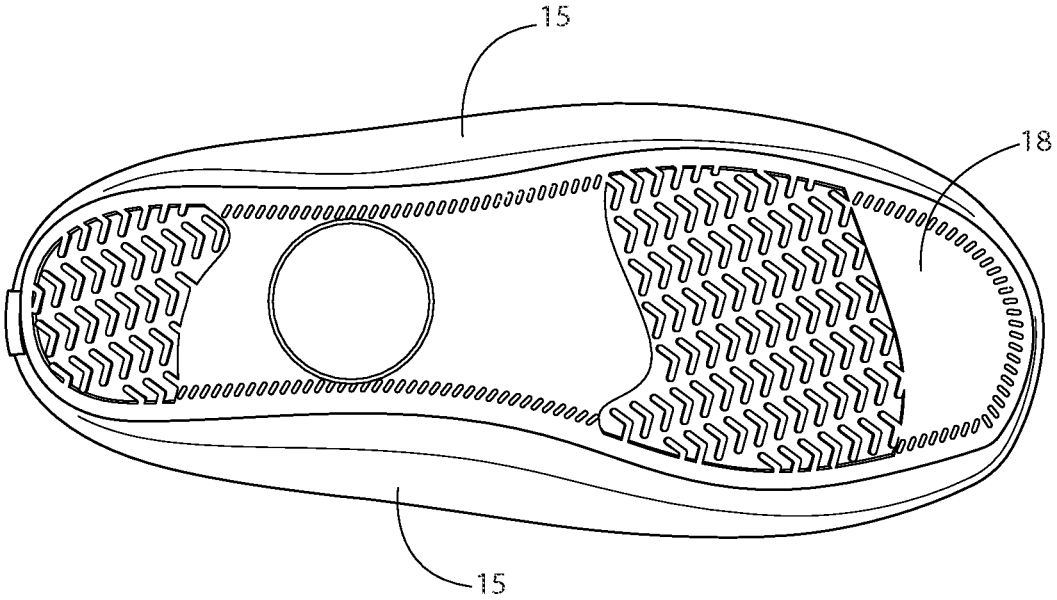
FIG. 3 depicts a bottom plan view of the footwear of FIG. 1.

The drawings are not intended to be limiting in any way, and it is contemplated that various embodiments of the invention may be carried out in a variety of other ways, including those not necessarily depicted in the drawings. The accompanying drawings, incorporated in and forming a part of the specification, illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

"Footwear" as used herein, means a device worn on a user's foot, for example, a shoe. Non-limiting examples of footwear may be a slipper, a sport shoe, a sandal, a boot, a dress shoe, etc.

It has been known to include memory foam in the insole, or bottom portion, of footwear. Memory foam is well-known in the art and is typically made from a viscoelastic polyurethane foam and is configured to mold to a body in response to heat and pressure. This allows the memory foam to provide cushioning that contours to unique features of individual feet. Such memory foam is also known in mattresses and pillows. It may further be desirable to provide such cushioning on the top and/or side portions of the footwear.

Accordingly, the footwear described herein includes memory foam positioned on the top portion and/or sides of the footwear to deliver cushioning to non-load bearing areas of a user's foot. The memory foam is softened by body heat to allow the memory foam to contour downward and/or horizontally into the upper and/or side contours of a user's foot. This three-dimensional contouring of the memory foam creates a unique comfort and cradling effect for the user's foot. While memory foam has been used as trim along the collar of footwear, such trim is insufficient to provide the three-dimensional contour for a unique comfort and cradling effect. Further, in some instances, the memory foam positioned underneath a user's foot has a low compression resistance such that it is prone to collapse at pressure points (e.g., the heel of a foot, the ball of a foot, etc.). This may reduce the cushioning capacity of the memory foam in these areas. By providing memory foam on the top portion and/or sides of the footwear, the three-dimensional contour and enhanced cushioning effect delivered to a user's foot reduces the negative impact of the low compression resistance or collapse of the memory foam under the foot. Accordingly, the enhanced cushioning feeling provided to the non-load bearing areas of the foot, such as the top and/or sides of the foot, offsets the feeling of loss of cushioning underneath the foot. An embodiment of footwear providing this three-dimensional contour is described below.

Figure 4:
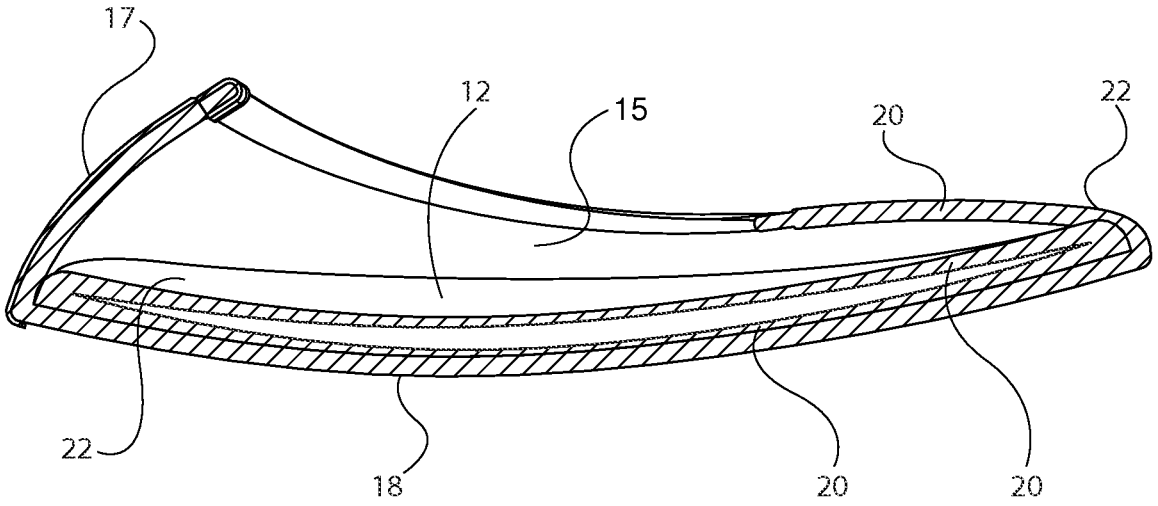
FIG. 4 depicts a cross-sectional view of the footwear of FIG. 1, taken along the line 4-4 of FIG. 2.

FIG. 1 illustrates footwear (10) as a slipper having a top portion (14) and a bottom portion (12) connected by sides (15) and back portion (17). An opening (16) is formed between the top portion (14) and the back portion (17), in which a user can insert his foot into the footwear. It should be noted that back portion (17) is merely optional such that the opening (16) is formed between the top portion (14) and sides (15). As best seen in FIG. 4, top portion (14), sides (15), back portion (17), and bottom portion (12) each contain memory foam (20). The memory foam (20) is sensitive to pressure and temperature. For instance, the memory foam (20) softens in reaction to body heat, allowing it to mold to a user's foot. The memory foam (20) can have a density of between about 40 and about 60 kg/m$^2$. The memory foam (20) can be supplied by Hyda, in Guanzhou, China.

By positioning the memory foam (20) in any one or more of the sides (15), back portion (17), and top portion (14) of footwear (10), instead of just in the bottom portion (12), the footwear (10) is able to deliver the contouring and cushioning benefit of the memory foam (20) to the top portion and/or the sides of the foot, rather than simply under the foot. This use of memory foam (20) on any one or more of the top portion (14), back portion (17), and sides (15) of footwear (10) delivers three-dimensional contouring in non load-bearing areas of the foot to enhance the cushioning effect of the memory foam (20). For instance, the memory foam (20) on the top portion (14), back portion (17), and sides (15) of footwear (10) is softened by body heat, allowing the memory foam (20) to contour downward into the upper and side contours or crevices of the foot, which creates a comforting, cradling effect. This three-dimensional contouring is a unique use of the contouring benefit of memory foam (20), creating compression comfort, in addition to cushioning and contouring comfort. With compression comfort, compression is transferred to the foot itself to create this comfort.

FIG. 4 shows the top portion (14), the back portion (17), and each side (15) comprising a layer of memory foam (20), and the bottom portion (12) comprising two layers of memory foam (20) such that the bottom portion (12) is thicker than the top portion (14) and sides (15). Any other suitable configurations for the thickness and/or layers of memory foam (20) can be used. Further, the memory foam (20) can be positioned in a select one of the top portion (14), the back portion (17), sides (15), or any combination thereof. In some embodiments, the back portion (17) is omitted such that the opening (16) is formed between the top portion (14) and sides (15). In some other embodiments, footwear (10) comprises an opening in the front portion of the footwear (10) such that the footwear (10) is open-toed. Other suitable configurations for footwear (10) will be apparent to one with ordinary skill in the art in view of the teachings herein.

Fabric (22) is then positioned around the memory foam (20). This fabric (22) can include a knitted or woven material that provides a sufficient amount of stretch to accommodate the movement of the user's foot and the memory foam. For instance, when a user inserts his foot into footwear (10), the fabric (22) may stretch outwardly in response to the user's foot. This may place the fabric (22) under tension to thereby exert pressure on the memory foam (20) to allow the memory foam (20) to mold to the user's foot. The stretch of the fabric (22) may also allow for footwear (10) to accommodate additional size and/or width ranges of individual user's feet. For instance, when the fabric (22) is stretched outwardly to thereby exert pressure on the memory foam (20), the three-dimensional contouring of the memory foam allows for a better fit to a user. This fit can, for example, eliminate the need for half sizes of the footwear (10). Still other suitable configurations for fabric (22) will be apparent to one with ordinary skill in the art in view of the teachings herein. Footwear (10) may further include a sole (18) positioned on the bottom of bottom portion (12). The sole (18) may comprise rubber or any other suitable material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An article of footwear comprising a load-bearing portion and memory foam in at least a non-load bearing portion of the footwear to provide three-dimensional contouring to a foot; and a fabric positioned around the memory foam, wherein the fabric comprises a sufficient amount of stretch to accommodate movement of the memory foam, wherein the memory foam is in at least a portion of a top of the footwear, wherein the fabric is configured to exert pressure on the memory foam in response to a foot to thereby aid in the three-dimensional contouring of the memory foam, wherein the load-bearing portion includes a first memory foam layer and a second memory foam layer, wherein the first memory foam layer and the second memory foam layer included in the load-bearing portion are connected only at front and rear portions of each of the first memory foam layer and the second memory foam layer, wherein the first memory foam layer and the second memory foam layer included in the load-bearing portion are not connected at first and second side portions of each of the first memory foam layer and the second memory foam layer, wherein a middle portion of the first memory foam layer is spaced apart from a middle portion of the second memory foam layer, wherein the load-bearing portion includes a rubber sole portion positioned at a bottom of the load bearing portion, wherein a top side of the rubber sole portion is adjacent to a bottom side of the second memory foam layer, and wherein a region disposed between the spaced apart middle portions of the first memory foam layer and the second memory foam layer does not include memory foam.

2. The article of claim 1, wherein the memory foam is in at least a portion of a side of the footwear.

3. The article of claim 1, wherein the memory foam is in at least a portion of a back of the footwear.

4. The article of claim 1, wherein the footwear comprises a slipper.

5. The article of claim 1, wherein the memory foam is in the entire top portion of the footwear.

6. The article of claim 1, wherein a thickness of the load-bearing portion is greater than a thickness of the non-load bearing portion.

7. An article of footwear comprising:

a top portion;

a bottom portion;

a pair of sides connecting the top portion with the bottom portion;

an opening formed between the top portion and the pair of sides, wherein the opening is configured to receive a foot; and a fabric positioned around the memory foam, wherein the fabric comprises a sufficient amount of stretch to accommodate movement of the memory foam;

wherein at least one of the top portion and the pair of sides comprises memory foam configured to provide three-dimensional contouring;

wherein the fabric is configured to exert pressure on the memory foam in response to the foot to thereby aid in the three-dimensional contouring of the memory foam, wherein the bottom portion includes a first memory foam layer and a second memory foam layer, wherein the first memory foam layer and the second memory foam layer included in the bottom portion are connected only at front and rear portions of each of the first memory foam layer and the second memory foam layer, wherein the first memory foam layer and the second memory foam layer included in the bottom portion are not connected at first and second side portions of each of the first memory foam layer and the second memory foam layer, wherein a middle portion of the first memory foam layer is spaced apart from a middle portion of the second memory foam layer, wherein the bottom portion includes a rubber sole portion positioned at a bottom of the bottom portion, wherein a top side of the rubber sole portion is adjacent to a bottom side of the second memory foam layer, and wherein a region disposed between the spaced apart middle portions of the first memory foam layer and the second memory foam layer does not include memory foam.

8. The article of claim 7 further comprising a back portion, wherein the back portion comprises memory foam.

9. The article of claim 7, wherein the memory foam has a density of between about 40 and about 60 $kg/m^2$.

10. The article of claim 7, wherein the memory foam is in the entire top of the footwear.

11. The article of claim 7, wherein a thickness of the bottom portion is greater than a thickness of the top portion.

* * * * *